US005484142A

United States Patent [19]

Demange

[11] Patent Number: 5,484,142

[45] Date of Patent: Jan. 16, 1996

[54] DEVICE FOR DRIVING DOCUMENTS GUIDED BY ONE EDGE ON A REFERENCE PLANE

[75] Inventor: Fabien Demange, La Voulte S/Rhone, France

[73] Assignee: Monetel S.A., Granges-Les-Valence, France

[21] Appl. No.: 338,130

[22] Filed: Nov. 9, 1994

[30] Foreign Application Priority Data

Nov. 30, 1993 [FR] France ..... 93/14611

[51] Int. Cl.[6] ..... B65H 9/16

[52] U.S. Cl. ..... 271/251; 271/252; 271/274

[58] Field of Search ..... 271/250, 251, 271/252, 253, 272, 271, 273, 274

[56] References Cited

U.S. PATENT DOCUMENTS

| | | | |
|---|---|---|---|
| 4,953,846 | 9/1990 | Azeta et al. | 271/251 |
| 5,074,546 | 12/1991 | Hanna et al. | 271/251 |
| 5,251,893 | 10/1993 | Schoenhenz | 271/251 |

FOREIGN PATENT DOCUMENTS

| | | | |
|---|---|---|---|
| 2148854 | 6/1985 | European Pat. Off. | 271/251 |
| 193258A2 | 9/1986 | European Pat. Off. . | |
| 2171395 | 8/1986 | United Kingdom | 271/251 |

OTHER PUBLICATIONS

Diel et al., Document Aligner, Feb. 1977, IBM Technical Disclosure Bulletin, vol. 19, No. 9, p. 3499.

*Primary Examiner*—William E. Terrell
*Assistant Examiner*—Carol L. Druzbick
*Attorney, Agent, or Firm*—Lowe, Price, Leblanc & Becker

[57] ABSTRACT

A device for driving documents having one edge in contact with a reference plane includes a drive roller having its axis perpendicular to the reference plane, and an idle roller pressing a drive document against the drive roller. The axis of the idle roller can be freely tilted in a plane parallel to the plane of the driven document, between two limit positions on either side of a position perpendicular to the reference plane. A spring urges the idle roller against an abutment at one end of its axis to create friction.

4 Claims, 3 Drawing Sheets

DEVICE FOR DRIVING DOCUMENTS GUIDED BY ONE EDGE ON A REFERENCE PLANE

BACKGROUND OF THE INVENTION

1. Field of the Invention

The present invention relates to devices for driving documents, such as checks, perpendicularly in contact with a reference plane, during a process, such as printing or reading magnetic or optic information.

2. Discussion of the Related Art

FIG. 1 is a perspective view of a conventional device for processing documents. The device includes a frame 10 on which is mounted a driving device formed by a pair of rollers 72 and 14 in contact with each other and having parallel axes. One of the rollers, drive roller 12, is generally of a material having a high adherence to the documents. The drive roller is rotated by a motor (not shown). The other roller, idle roller 14, freely rotates about its axis. The frame 10 includes a reference plane 10-1 to which the roller axes are perpendicular and against which should be urged the lower edge of a document 16 driven by the device. In practice, this reference plane is the bottom of a groove 10-2 for guiding the document 16.

The documents to be driven arrive, inserted by hand or by another driving device, between the two rollers and are then dragged by adherence to the drive roller 12. The idle roller 14 provides sufficient pressure of the documents against the drive roller so that they are dragged.

In systems which process the documents, such as for printing or reading magnetic or optic information, the documents should have one of their edges in contact with a reference plane, which provides a reference for processing the documents. A processing device, designated 17, is represented in FIG. 1.

A first solution to ensure the contact with a reference plane is to provide the documents already in contact with the reference plane to the driving device and to construct the rollers (idle or drive roller) with an axis as perpendicular as possible to the reference plane 10-1. This solution requires a manufacturing accuracy that is particularly expensive.

Another solution is to tilt the axis of one of the rollers, generally the idle roller, in a plane parallel to the plane of the driven document 16. With such a solution, when the drive roller rotates in the "right" direction, the inclination of the idle roller urges the document towards the reference plane as it is driven. To limit the pressure applied to the document 16 once the latter is in contact with the reference plane 10-1, the idle roller is generally of a material having a low adherence. In contrast, if the drive roller rotates in the wrong direction, the driven documents are separated from the reference plane.

Thus, such a driving device which is inexpensive to manufacture is a unidirectional device.

European patent application 193,258 describes a device for driving documents having one edge in contact with a reference plane. The driving device includes a drive roller having its axis perpendicular to the reference plane and an idle roller pressing a driven document against the drive roller. The axis of the idle roller is freely tiltable in a plane parallel to the plane of the document, between two limit positions on either side of a position perpendicular to the reference plane.

A minimum resistance to rotation is provided between the idle roller and its axis, but the idle roller should be tiltable as freely as possible.

To reduce the resistance to tilting, the support of the idle roller is mounted to the frame through a ball-bearing. This mounting solution is particularly expensive and difficult to carry out, because the ball-bearing, which is very small, must be mounted with a high axial accuracy in order to ensure that the idle roller exerts sufficient pressure on the drive roller.

SUMMARY OF THE INVENTION

An object of the present invention is to provide a tiltable idle roller document driving device, in which the configuration allowing the tilting of the idle roller is inexpensive and easy to mount.

According to the invention, the configuration of the idle roller support includes, at the most distant side from the drive roller, an elastically urged piston ended by a tip penetrating in a female cone of the frame.

According an embodiment of the invention, the configuration includes, at the side nearest to the drive roller, a finger penetrating in a groove of the frame that is parallel to the axis of the drive roller, and stopped by one end of the groove.

According to an embodiment of the invention, the support has an extension cooperating with a portion of the frame to limit the inclination of the idle roller.

According to an embodiment of the invention, the friction means include a spring urging the idle roller against an abutment of the axis of the idle roller.

The foregoing and other objects, features, aspects and advantages of the invention will become apparent from the following detailed description of the present invention when taken in conjunction with the accompanying drawings.

DETAILED DESCRIPTION

Figure 1:
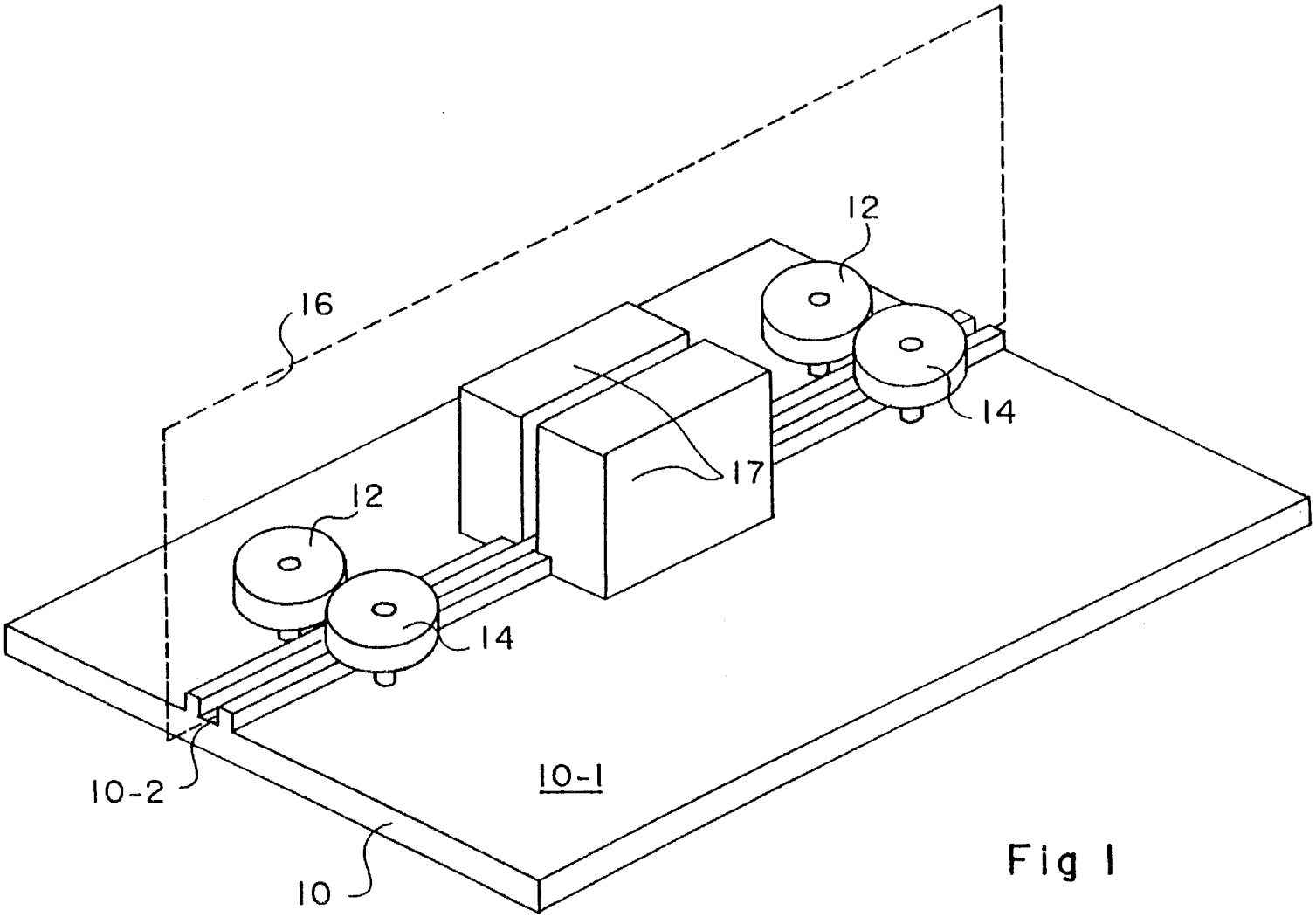
Fig 1 PRIOR ART
FIG. 1, above described, represents a conventional device for processing documents.
Figure 2A:
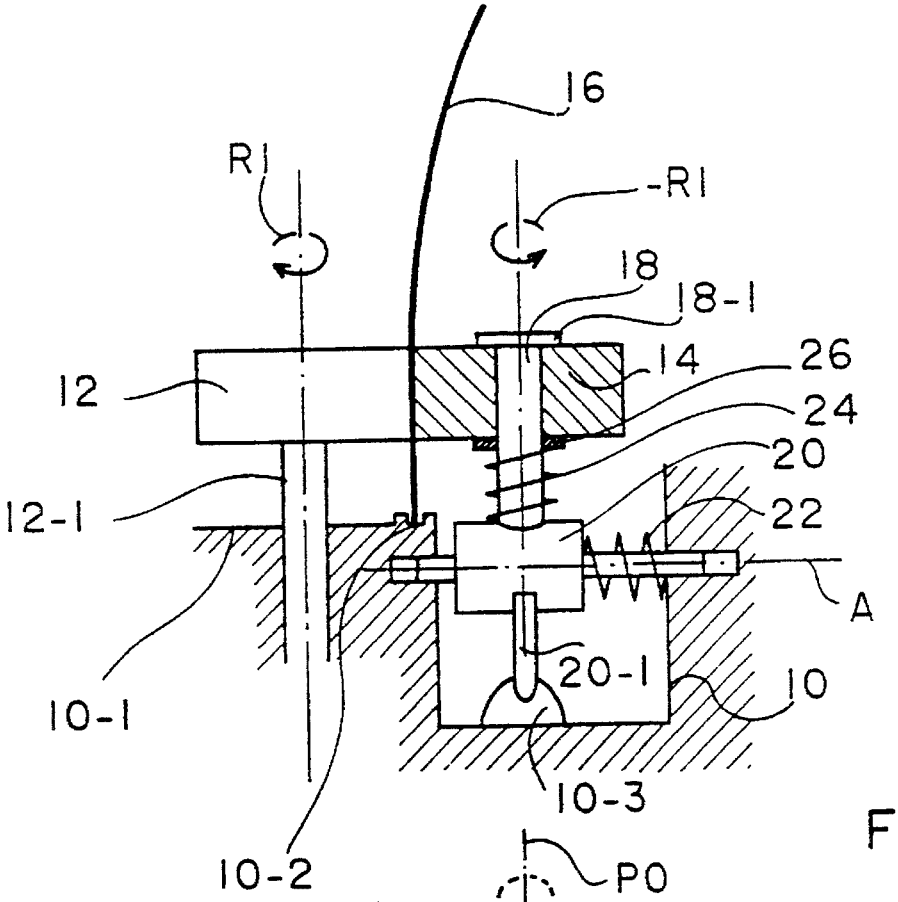
FIGS. 2A and 2B are a front view and a side view, respectively, of an embodiment of a document driving device.
Figure 2B:
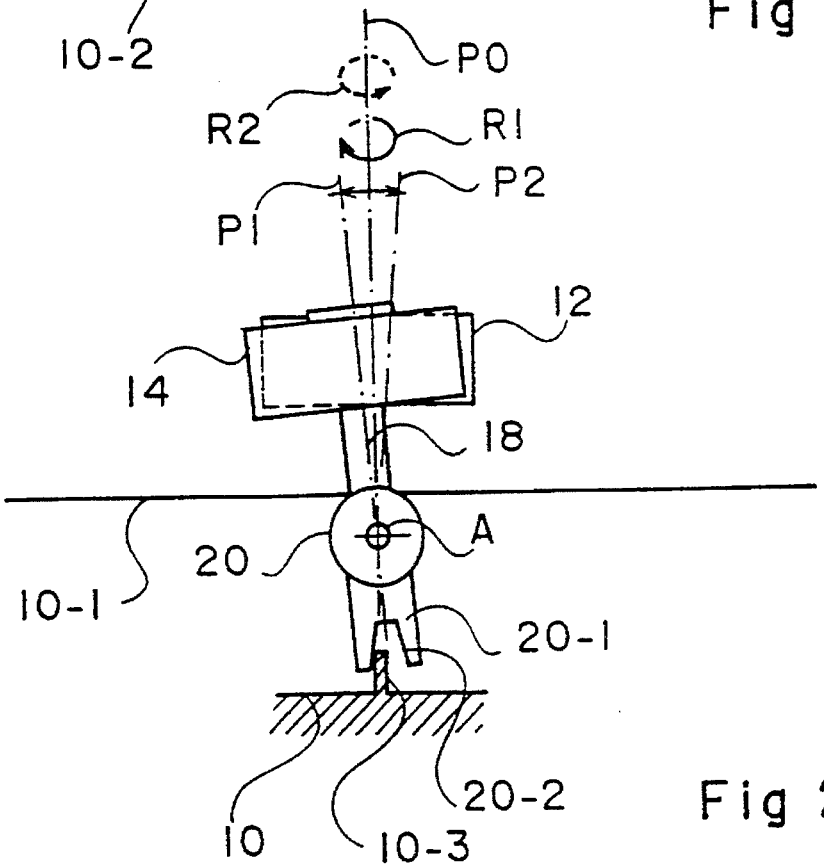

FIGS. 2A and 2B represent the same elements as those in FIG. 1, designated with the same reference numerals. A drive roller 12 and an idle roller 14 are mounted on a frame 10. Roller 12 has an axis 12-1 guided in a bearing of frame 10, which allows to rotate roller 12, for example, with a motor (not shown) located in the lower part of the frame.

Frame 10 includes a reference plane 10-1 to which axis 12-1 of roller 12 is perpendicular and toward which the lower edge of a document 16, driven by the device, has to be urged. Like the device of FIG. 1, this reference plane is at the bottom of a groove 10-2 for guiding document 16.

The idle roller 14 rotates about an axis 18 integral with a support 20, in turn mounted on frame 10 along an axis A which is perpendicular to the plane of document 16, and crosses axis 12-1 of the drive roller. Support 20 is slidably mounted along axis A. A spring 22, compressed between support 20 and a wall of frame 10, maintains the idle roller 14 in contact with the drive roller 12. Thus, the document 16 is maintained in contact with the drive roller 12 which drags the document by friction.

The support 20 imparts to axis 18 of the idle roller 14 a free inclination in a plane parallel to the plane of document 16, to both sides of a position PO parallel to axis 12-1 of the drive roller. The inclination of axis 18 is limited between two limit positions P1 and P2 on both sides of position PO by a double abutment. This double abutment includes, for example, an extension 20-1 of support 20 ending at its distal extremity by a fork 20-2 parallel to the plane of document 16 and overlapping a flat extension 10-3 of the frame.

With this configuration, provided there is a determined rotation resistance of the idle roller 14 about its axis 18, the axis of the idle roller 14 reaches its limit position P1 or its limit position P2 depending upon the rotation direction of the drive roller 12. As represented, if the drive roller 12 rotates in a direction R1, the idle roller 14 rotates in an opposite direction -R1 and reaches its limit position P1. If the drive roller 12 rotates in an opposite direction, as represented by a dotted arrow R2, the idle roller 14 tilts in the opposite direction and reaches its limit position P2. Accordingly, whatever the rotation direction of the drive roller 12, that is, whatever the driving direction of documents 16, the idle roller tilts in a direction where it always urges the lower edge of document 16 against the reference plane 10-1.

The end positions P1 and P2 correspond to inclinations of only a few degrees with respect to position PO. The idle roller is of a low friction material, so that the force applied to document 16 does not crumple it.

It is important, in order to obtain a good operation of the device, that the friction between the idle roller 14 and its axis 18 is sufficient to overcome the resistance to tilting about axis A, by applying a tangential force on roller 14. Indeed, the rotation of the drive roller 12 cannot otherwise tilt roller 14.

In an embodiment, to provide sufficient friction of substantially constant value over time, roller 14 is slidably mounted on its axis 18, and a spring 24 is compressed between support 20 and the lower surface of roller 14 and urges the upper surface of roller 14 towards an abutment of axis 18, such as a shoulder or an elastic ring 18-1. A ring 26 is placed between spring 24 and roller 14.

Figure 3:
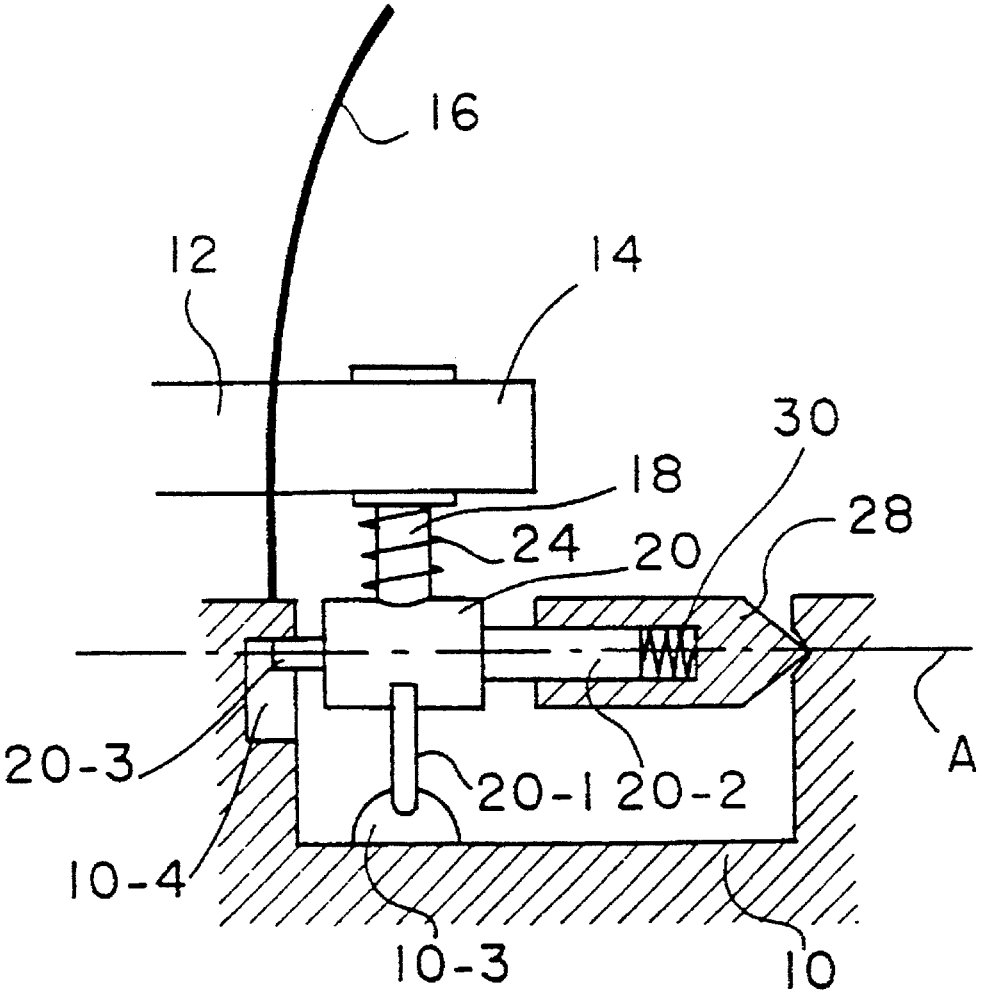
FIG. 3 represents an embodiment of a configuration of a tiltable idle roller according to the present invention.

Additionally, it is desirable to reduce the resistance to tilting about axis A so that it does not unduly increase the friction necessary in consequence between roller 14 and its axis 18. A too high friction between roller 14 and axis 18 would require to increase the size of the motor of roller 12, which has to overcome this friction. FIG. 3 represents an embodiment of a low friction configuration according to the invention. Support 20 includes, at the most distant side from the drive roller 12, a cylindric extension 20-2 covered by a piston 28. The piston 28 ends with a male cone placed in a female cone of frame 10. A spring 30 is compressed between the end of extension 20-2 and the top of piston 28 to urge the idle roller 14 against the drive roller 12 and to hold the configuration together.

Support 20 includes, at the side nearest to the drive roller 12, a finger 20-3 along axis A which penetrates in a vertical groove 10-4 of frame 10. The groove 10-4 is perpendicular to the plane of document 16. Finger 20-3 comes into abutment against the upper end of groove 10-4.

This configuration is very easy to mount and has a particularly low friction.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended as limiting. The invention is limited only as defined in the following claims and the equivalents thereto. In particular, other arrangements than those described can be provided to obtain sufficient friction between the idle roller and its axis and to obtain the limit inclination positions of the idle roller.

I claim:

1. A device for driving documents having one edge in contact with a reference plane including:

a drive roller having its axis perpendicular to the reference plane;

an idle roller pressing a driven document against the drive roller;

a support for the idle roller, mounted on a frame so that an axis of the idle roller can be freely tilted in a plane parallel to the plane of the driven document, between two limit positions on either side of a position perpendicular to the reference plane;

friction means between the idle roller and its axis; and an elastically urged piston ended by a tip penetrating in a female cone of the frame; wherein said support includes a first extension along an axis substantially perpendicular to the axis of said drive roller, for insertion into a recess in said piston.

2. The device of claim 1, wherein said support includes, at a side opposite said first extension, a finger penetrating in a groove of the frame parallel to the axis of the drive roller, and stopped by one end of the groove.

3. The device of claim 1, wherein the support has a second extension cooperating with a portion of the frame for limiting the inclination of the idle roller.

4. The device of claim 1, wherein said friction means include a spring urging the idle roller against an abutment of the axis of said idle roller.

* * * * *